United States Patent [19]

Stowe et al.

[11] 4,325,244

[45] Apr. 20, 1982

[54] SELF-REPAIRING WIPER DIE

[76] Inventors: Robert L. Stowe, 6696 Carriage Dr., Mableton, Ga. 30059; Wilbur B. Taylor, 3499 Chestnut Dr., Doraville, Ga. 30340

[21] Appl. No.: 183,420

[22] Filed: Sep. 2, 1980

[51] Int. Cl.[3] ..... B21D 7/04

[52] U.S. Cl. ..... 72/158

[58] Field of Search ..... 72/149, 150, 154, 155, 72/157, 158, 159, 369, 370, 473, 478, 481, 482

[56] References Cited

U.S. PATENT DOCUMENTS

| | | | |
|---|---|---|---|
| 878,604 | 2/1908 | Brinkman | 72/159 X |
| 1,135,875 | 4/1915 | Brinkman | 72/159 X |
| 1,261,191 | 4/1918 | Vallone | 72/159 X |
| 2,721,651 | 10/1955 | Roth | 72/478 |
| 2,777,500 | 1/1957 | Ekholm et al. | 72/150 X |
| 3,410,125 | 11/1968 | Schmidt | 72/156 |
| 3,456,482 | 7/1969 | Maier et al. | 72/159 X |
| 3,457,753 | 7/1969 | Maier et al. | 72/159 X |
| 3,898,835 | 8/1975 | Winter et al. | 72/481 X |
| 4,009,601 | 3/1977 | Shimizu | 72/150 X |

*Primary Examiner*—Ervin M. Combs

[57] ABSTRACT

This invention relates to a wiper die arrangement improvement for use on tube bending machine tools, and comprises an assembly (18) including a base member (19) that can be mounted to the tube bending machine and a wiper die insert member (20) engaged with the base whereby the insert member (20) can be longitudinally adjusted to compensate for wear or damage of the feather-edge (32 thereon) without the necessity for realignment or set up readjustment of the base member (19) to the bending machine.

6 Claims, 8 Drawing Figures

SELF-REPAIRING WIPER DIE

TECHNICAL FIELD

This invention concerns improvement in wiper die structures used in conjunction with tube bending machines for the draw forming of bends or deflections in metal tubes or pipes. In the tube bending art it has been known that as a metal tube workpiece is clamped to a rotary driven forming die and then drawn therearound to form a bend or deflection in the tube workpiece conforming to the radius or shape of the forming die, in thinner walled tubing there results a tendency of wrinkling of the tube wall proximate the inner radius area of the formed bend or deflection. This wrinkling is explained as a stretching or drawing of the outer radius portion of the tube wall offset by such gathering or wrinkling of the inner radius portion of the tube wall. By the use of a wiper die located adjacent to the tube bending forming die and substantially at or just immediately preceding the tangency point at where the tube bend or deflection begins, such tube wall gathering or wrinkling is substantially, if not completely, eliminated.

BACKGROUND ART

The use of a wiper die to solve the tube wrinkling problem discussed above is known in the prior art as exemplified by items 11, 43, 48 and 173 respectively in U.S. Pat. Nos. 878,604, 1,135,875, 1,261,191 and 3,456,482. Each of these prior art wiper dies involves the necessary complex underside surface generation to enable the forward portion of the wiper die to coact with the surface configuration of the forming die and yet extend forward sufficiently enough to provide as much sidewall support for the tube workpiece as possible prior to its reaching its tangency point with the forming die. When this forward portion of the wiper die, which is referred to as the feather-edge in the tube bending art, is worn or damaged and thereby presents a gap between such feather-edge and the point of tangency with the forming die where the tube bend or deflection forming begins, the wrinkling or gathering of the inner radius of the tube wall as described above has a tendency to begin, which in turn results in an unsmooth inner tube wall at or through the bend. To compensate for this gap due to wear and continue to attain high quality tube bends, the production process must be interrupted for an operator to replace, readjust and realign the mounting of another wiper die to the tube bending machine.

DISCLOSURE OF THE INVENTION

This invention comprises a wiper die assembly of a base member and a feather-edge containing insert member that is longitudinally adjustable relative to the base member by a screw member whereby the feather-edge of the insert can be independently adjusted toward and away from the forming die tangency point by the screw member without the need or necessity of time-consuming and difficult readjustment or realignment of the base.

Additionally, by the selective use of a soft metallic alloy for the insert member such as an aluminum bronze, a slightly higher wear rate from the tubing workpiece running through the groove of the insert results in a self-repairable finishing of a feather-edge that has been damaged as the result of dropping or mishandling, and as the wear occurs, the feather-edge of the insert is easily moved toward the tangent point location of the forming die by merely turning the screw member for relative movement between the insert and the stationary mounted base members. An additional benefit realized by the use of the softer insert as compared to the conventional steel wiper die is the greater inherent lubricity between the tube workpiece and the insert member during the rubbing contact therebetween during forming of the tube workpiece as it is drawn over and supported by the insert in wiper die contact with the tube workpiece.

DETAILED DESCRIPTION

Figure 1:
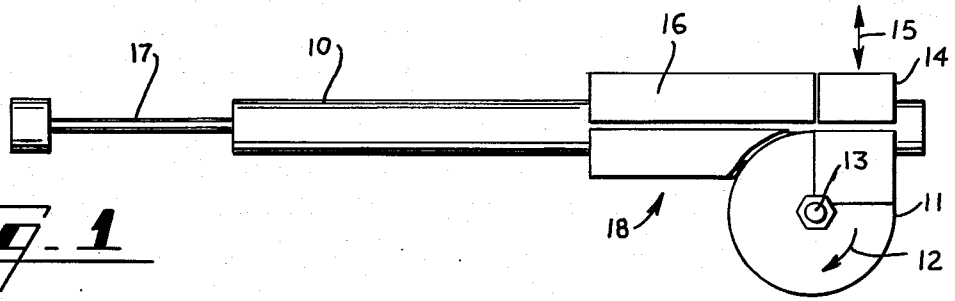
FIG. 1 shows the relative relationships of several members, including a wiper die assembly of this invention, on a tube bending machine before the beginning of a tube bending operation with a length of tubing which is to be draw bent on the machine.
Figure 3:
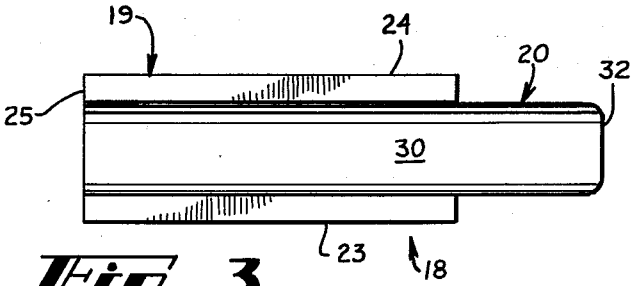
FIG. 3 is a top plan view of such a wiper die assembly.
Figure 4:
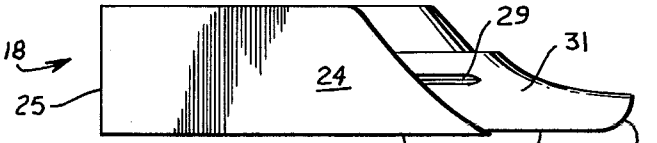
FIG. 4 is a side view of such a wiper die assembly.
Figure 2:
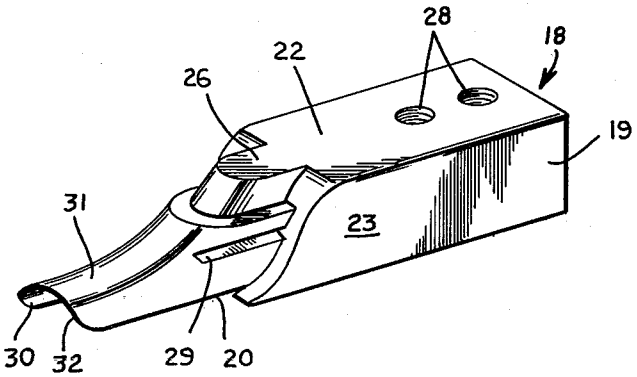
FIG. 2 is a perspective view of one embodiment of a wiper die assembly of this invention.

Referring particularly to FIG. 1, there is shown a conventional arrangement of members or elements that are mounted on the bed (not shown) of a tube bending machine preparatory to forming a bend in a tube member or workpiece 10. A bend die 11 is mounted to a rotating bed portion (not shown) of the bending machine so as to be rotationally driven in the direction of arrow 12 about pivotal axis 13. A clamping member 14 is conventionally mounted on the tube bending machine in such a manner as to be movable toward and away from the bend die 11 in a linear manner as shown by the arrowed line 15, as well as rotationally movable with bend die 11 about the pivotal axis 13. Also shown are conventional members of a pressure block 16 and a mandrel 17, along with a wiper die assembly 18 that is configured according to this invention.

Details of wiper die assembly 18, which constitutes this invention, are shown in FIGS. 2 through 8, which comprises a base member 19, an insert member 20, and an adjusting member 21. The base member 19 consists of a U-shaped channel configuration having a bottom surface 22, side surfaces 23, 24 and rearward end surface 25. On the forward end of base member 19 is a tang 26, the purpose and configuration of which will be explained in more detail hereinafter. Along each interior sidewall of the channel formed by base member 19 is a longitudinal extending V-rail 27 for sliding engagement in corresponding grooves in the insert member 20 as discussed below. Extending into or through the base member 19 from bottom surface 22 are shown a pair of threaded holes 28 to constitute a part of the arrangement whereby the base member 19 can be securely mounted or connected to the tube bending machine structure (not shown) and thereby result in the mounting or connection of the wiper die assembly to the tube bending machine; it being understood that holes 28 are merely exemplary, and that such mounting or connection of wiper die assembly 18 to the machine may be in any conventional manner available to and practiced in the art.

Insert member 20 consists of a longitudinally extending structure having bottom and side surfaces shaped and sized to permit longitudinal sliding engagement in the channel of base member 19; the sliding retention of insert member 20 in the channel being maintained by engagement of the V-rails 27 in corresponding V-grooves 29 in the side walls of insert 20 as best seen in FIGS. 2, 4, 5 and 6. The upper surface 30 of insert member 20 is of arcuate or semi-circular configuration and define a tube groove sized to correspond to the outer diameter surface of the tube workpiece having a bend or deflection formed therein on the tube bending machine. The forward end of insert member 20 is shaped to form a geometrically curved transition surface 31 between the bottom and side surfaces into the top surface of the insert 20 to in turn form a feather-edge 32 at the intersection of the forward end transition surface 31 with the upper surface or tube groove 30.

The sizes and configurations of transition surface 31 and the forward end of a tang 26 are such that they will conform to the rim thicknesses and diameter of the bend die 11 tube workpiece groove therein to in turn permit the location of feather-edge 32 at, or as close as possible to the tangency point between the tube workpiece and bend die 11 where the tube bend or deflection begins whereby any tube wall gathering or wrinkling discussed above is substantially, if not completely, eliminated.

Figure 7:
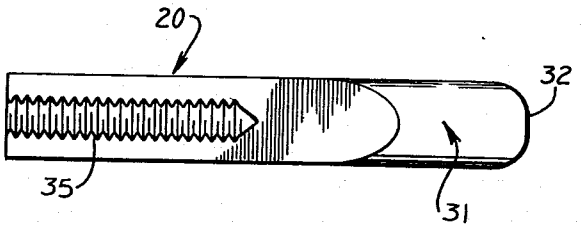
FIG. 7 is a bottom view of an insert member of the assembly of this invention; and, FIG. 8 is a top plan view of a base member of this invention with the insert member removed.
Figure 6:
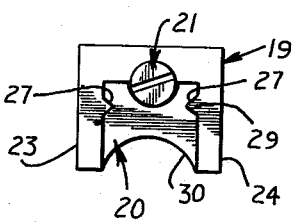
FIG. 6 is a rear view of such a wiper die assembly.
Figure 5:
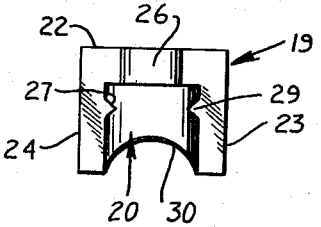
FIG. 5 is a front view of such a wiper die assembly.
Figure 8:
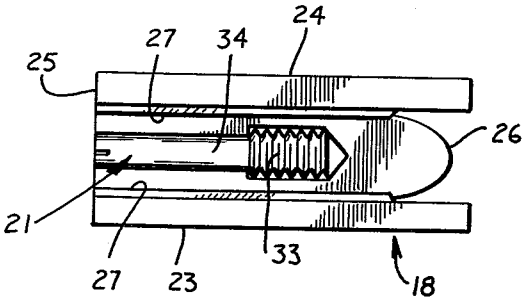

For relative longitudinal adjustment between the base member 19 and insert member 20, we provide an adjusting member 21 that is functionally quite similar to a worm gear, and which is best seen in FIG. 8. This adjusting member 21 has an external threaded portion 33 and a shaft portion 34 whose diameter is sufficiently reduced or undercut to eliminate any interference with any thread engagement of portion 33 with another member upon turning a shaft 34. Member 21 is located in a substantially semi-circular cross-sectioned unthreaded cutout in the bottom of the channel formed by base member 19. The bottom surface of insert member 20 has a longitudinally-extending, semi-circular threaded portion 35 as seen in FIG. 7 for engagement with threaded portion 33 of adjusting member 21. Thusly, when insert 20 is located within the channel of base member 19 and the rails 27 are engaged with the grooves 29, and the threaded portion 33 of adjusting member 21 is engaged with threads 35 of insert 20, said insert 20 may be longitudinally moved or adjusted in either direction relative to base 19 by the selective turning of member 21.

While the members 19, 20 and 21 that constitute the assembly of this invention are preferably of metallic materials, we have found it more beneficial and advantageous to utilize for insert 20 a soft metallic alloy as exemplified by annealed wrought aluminum bronze as covered by Federal Specification Nos. QQ-C-465 CU 630/642 and 7075-T651 aluminum as covered by Federal Specification QQ-A-225/9B. When insert 20 is made of such softer metallic materials and alloys, it is provided with a self-repairing capability since the working surfaces of the tube groove 30, the feather-ege 32, and the transition surface 31 will wear slightly and evenly during the tube bending process as the tube workpiece slides through the tube groove 30 of insert 20 and the feather-edge 32 and/or transition surface 31 is adjusted into contact with the bend die 11. By the range of such adjustment to insert 20 relative respectively to base member 19 and bend die 11, we find that an exceptionally long wiper die tool life is provided over that experienced by prior art wiper dies of unitary steel constructions.

We have found that the natural lubricity of the aluminum bronze alloy provides a smooth sliding tube to die contact surface, wrinkles in the tubing becomes practically non-existant, scratches on soft alodized tubing from the bending were substantially reduced if not eliminated, ovality in the tube bend area was reduced, and that the set-up and test job run times as well as the tubing scrap rates normally associated with one piece steel wiper dies were all reduced.

While both ferrous and nonferrous materials are also satisfactory for the base member 19, we find the lighter weight materials improve ease of handling to reduce machine set-up time, especially for bending tubing of larger diameter.

OPERATION OF THE INVENTION

Because of the wiper die assembly 18 as detailed above whereby adjustability of the insert 20 can be made relative to both the base member 19 and the bend die 11 by merely turning adjustment member 21 without having to undergo the time consuming realignment and set-up of the base member 19 relative to bend die 11 to compensate for feather-edge wear or damage or mere refinement of base 19 location, great flexibility with reduction in both machine and manhours in tube bending operations is attained.

While particular embodiments of the invention have been illustrated and described, it will be obvious to those skilled in the art that various changes and modifications may be made without departing from the invention, and it is intended to cover in the appended claims all such modifications and equivalents that fall within the time spirit and scope of this invention.

We claim:

1. A wiper-die assembly for mounting on a tube bending machine comprising:

a metallic base means having an outer bottom surface and configured to define a longitudinal U-shaped channel by a pair of channel sidewalls and a channel floor, said channel extending completely through the longitudinal length of said base means;

a longitudinally extending metallic insert means having an upper, lower, and pair of sidewall surfaces, said lower and sidewall surfaces of the insert means configured to slideably engage longitudinally with the sidewalls and floor of said base means channel when the insert means is located in the channel;

the upper surface of said insert means configured to form a semi-circular longitudinal channel therealong with said channel having a diametric value of no greater than the width of the base means channel;

the longitudinal length of said upper surface of said insert means being greater than that of the insert means lower and sidewall surfaces such that one end of the insert means is configured to provide a curvatured transition section that extends from the insert means lower and sidewall surfaces to termination in a sharp feather-edge substantially tangent to the semi-circular channel in the insert means upper surface;

cooperative retention means in the sidewalls of said base means channel and the sidewalls of said insert means whereby when the insert means is located within the base means channel, the insert means may be selectively slid in the channel in either longitudinal direction while restrained from an upward direction out of said first means channel;

and, a metallic adjusting means for making a relative longitudinal movement between the base means and the insert means, said adjusting means comprising an axially extending rotatable member having a threaded portion thereon nesting in a longitudinal semi-circular cutout in the channel floor surface of said base means with the threaded portion engaging a longitudinal semi-circular and threaded cutout in the lower surface of the insert means whereupon the insert means may be moved in either direction longitudinally in the base means channel upon selective rotation of said rotatable member.

2. A wiper-die assembly for mounting on a tube bending machine as claimed in claim 1 wherein said insert means is of a metallic material having softer properties than the metallic materials of said base means.

3. A wiper-die assembly for mounting on a tube bending machine as claimed in claim 2 wherein said insert means is of an annealed wrought aluminum bronze alloy.

4. A wiper-die assembly for mounting on a tube bending machine as claimed in claim 2 wherein said insert means is of 7075-T651 aluminum.

5. A wiper-die assembly for mounting on a tube bending machine as claimed in claim 1 wherein said base means includes an additional means adapted to permit the mounting of said base means to a tube bending machine through cooperative structure associated with the tube bending machine.

6. A wiper-die assembly for mounting on a tube bending machine as claimed in claim 5 wherein said additional means comprises at least a pair of threaded holes located on the outer bottom surface of said base means.

* * * * *